US006434240B1

(12) United States Patent
Kulas

(10) Patent No.: US 6,434,240 B1
(45) Date of Patent: Aug. 13, 2002

(54) SOUND ISOLATION CABINET USING TWO SOUND SOURCES TO GENERATE COMPLIMENTARY SOUND WAVES

(76) Inventor: Charles J. Kulas, 244 Texas St., San Francisco, CA (US) 94107

( * ) Notice: Subject to any disclaimer, the term of this patent is extended or adjusted under 35 U.S.C. 154(b) by 0 days.

(21) Appl. No.: 08/993,333

(22) Filed: Dec. 19, 1997

(51) Int. Cl.[7] ..... H04R 1/02
(52) U.S. Cl. ..... 381/89; 381/58; 381/345
(58) Field of Search ..... 381/98, 56, 58, 381/59, 89, 337–339, 345–349; 181/141–147, 199

(56) References Cited

U.S. PATENT DOCUMENTS 3,710,034 A * 1/1973 Murry ..... 381/19
4,016,953 A 4/1977 Butler
4,592,088 A * 5/1986 Shimada ..... 381/96
4,882,760 A 11/1989 Yee
5,073,945 A 12/1991 Kageyama et al.
5,147,986 A * 9/1992 Cockrum et al. ..... 181/145
5,181,247 A * 1/1993 Holl ..... 381/306
5,590,208 A * 12/1996 Koyano et al. ..... 381/345
5,629,502 A * 5/1997 Nakano ..... 181/145
5,710,395 A * 1/1998 Wilke ..... 181/153
6,031,919 A * 2/2000 Funahashi et al. ..... 381/351

* cited by examiner

*Primary Examiner*—Minsun Oh Harvey

(57) ABSTRACT

Two or more speakers are used to generate complimentary sound waves within a soundproof cabinet. The sounds generated inside the cabinet are detected by a microphone and sent to an external device for recording or listening purposes. In one embodiment, two speakers are arranged side-by-side and mounted on a panel. The panel serves to section off two chambers within the cabinet. The primary chamber is the chamber toward which the speakers are facing. The secondary chamber is the chamber within which the backs of the speakers are positioned. The speakers are connected to the input signal in reverse polarity of each other. Thus, during operation one speaker is pushing air outward while the other is pulling air inward. This complimentary generation of sound waves alleviates the muffling effect of the small isolated space and allows the speakers to generate sound as though they were in a much larger open area. Thus, the sound picked up by the microphone is very close to the desired "live" sound.

23 Claims, 2 Drawing Sheets

SOUND ISOLATION CABINET USING TWO SOUND SOURCES TO GENERATE COMPLIMENTARY SOUND WAVES

BACKGROUND OF THE INVENTION

This invention relates in general to sound isolation cabinets useful for recording musical instruments such as electric guitars, and more specifically to a sound isolation cabinet using complimentary sound sources to generate improved isolated sound.

It is very difficult to accurately reproduce an electric guitar's "live" sound in an isolated space. However, it is very desirable to do so because isolating the sound allows the sound to be recorded without bothering other people such as neighbors in an apartment building. Also, isolating the sound prevents other sounds from interfering with the recording of the electric guitar sound as in professional recording situations where a live performance requires other loud instruments to play at the same time as the electric guitar.

Two approaches have been made to isolate an electric guitar sound. One is the direct approach where the sound is maintained as a purely electronic signal. The other is the "isolation cabinet" approach where the sound is reproduced acoustically in an enclosed space.

The "direct" approach to recording electric guitars has been tried for many years. Many pre-amplifiers, equalizers and sound effects gadgets are available to enhance the direct signal from the guitar so that the processed signal can be directly used for recording, or for reproducing in headphones or for other purposes. However, none of the available direct equipment produces a sound as pleasing, or desired, as the tone achieved when the electric guitar is played at amplified volume through speakers. Since this mode is the way the electric guitar is played in a live concert, it is sometimes referred to as the "live" sound of the electric guitar.

One reason the direct approach fails to reproduce the live sound is that there is a "speaker effect," or coloration of the sound due to the speaker or speakers. Different speakers have different sounds and are sought after for different types of music according to the tastes of the particular musicians. For example, speakers such as the "Greenback" speaker manufactured by Celestion International, Ltd., Foxhall Rd., Ipswitch Suffolk, England, are very desirable for gritty, distorted "rock 'n roll" tones. The number and variety of speakers is large. Each adds a slightly different color to the tone. Apparently the complex wave effects of the speaker cone's vibrating surface in air makes for a more interesting tone that is lost when using the direct approach.

Another reason that the direct approach fails to reproduce the live tone of an electric guitar is that some guitar tones are only fully realized at high output from an amplifier. For example, amplifiers made by Marshall Products, Ltd., Bletchley, England, are highly desirable for certain types of music, but certain of their tones are only realized when the amplifier's power output stage is set to a high output level. Although the prior art uses resistive loading, inductive loading and other techniques to try to "siphon" off a direct signal from an amplifier's power output, these methods fail to yield a sound that is, by many standards, even remotely close to the live sound.

Given the shortcomings of the direct approach, attempts have been made to produce "isolation cabinets" which are little more than enclosed boxes containing a speaker and a microphone. The electric guitar output is amplified and fed to the speaker which produces sound that is picked up by the microphone. The signals from the microphone are routed to other external devices for audibly playing the sound, or recording the sound. Since the electric guitar is amplified and driving a speaker, this setup is the same as the live setup. However, these approaches have failed to produce a pleasing reproduction of the guitar tone. The reason for this is that the speaker is "damped" or restricted in it's freedom to vibrate because of the compression of air in a small volume necessary to contain the sound. To date, no isolation cabinet exists that can approach the live sound to the point where it can effectively be used to record a certain live-sounding guitar tones in professional recordings. For example, the Internet page "www.cybtrans.com/guitar/g101.htm" includes a discussion on isolation cabinets, and the failings of some commercially available cabinets.

SUMMARY OF THE INVENTION

The present invention is a sound isolation cabinet that uses two or more speakers to generate complimentary sound waves within the sound-proof cabinet. The sounds generated inside the cabinet are detected by a microphone and sent to external device for recording or listening purposes. In one embodiment, two speakers are arranged side-by-side and mounted on a panel. The panel serves to section-off two chambers within the cabinet. The primary chamber is the chamber toward which the speakers are facing. The secondary chamber is the chamber within which the backs of the speakers are positioned. The speakers are connected to the input signal in reverse polarity of each other. Thus, during operation one speaker is pushing air outward while the other is pulling air inward. This complimentary generation of sound waves alleviates the muffling effect of the small isolated space and allows the speakers to generate sound as though they were in a much larger open area. Thus, the sound picked up by the microphone is very close to the desired "live" sound.

A preferred embodiment of the invention uses: a cabinet enclosure; an input for receiving an external electrical signal; first and second speakers positioned in the isolation cabinet, wherein the speakers are responsive to the electrical signal to produce sound by moving air within the cabinet; and a coupling between the input and the first and second speakers so that the air in the cabinet is moved in a complimentary fashion to produce sound within the cabinet in response to the electrical signal.

DESCRIPTION OF THE PREFERRED EMBODIMENT

Figure 1:
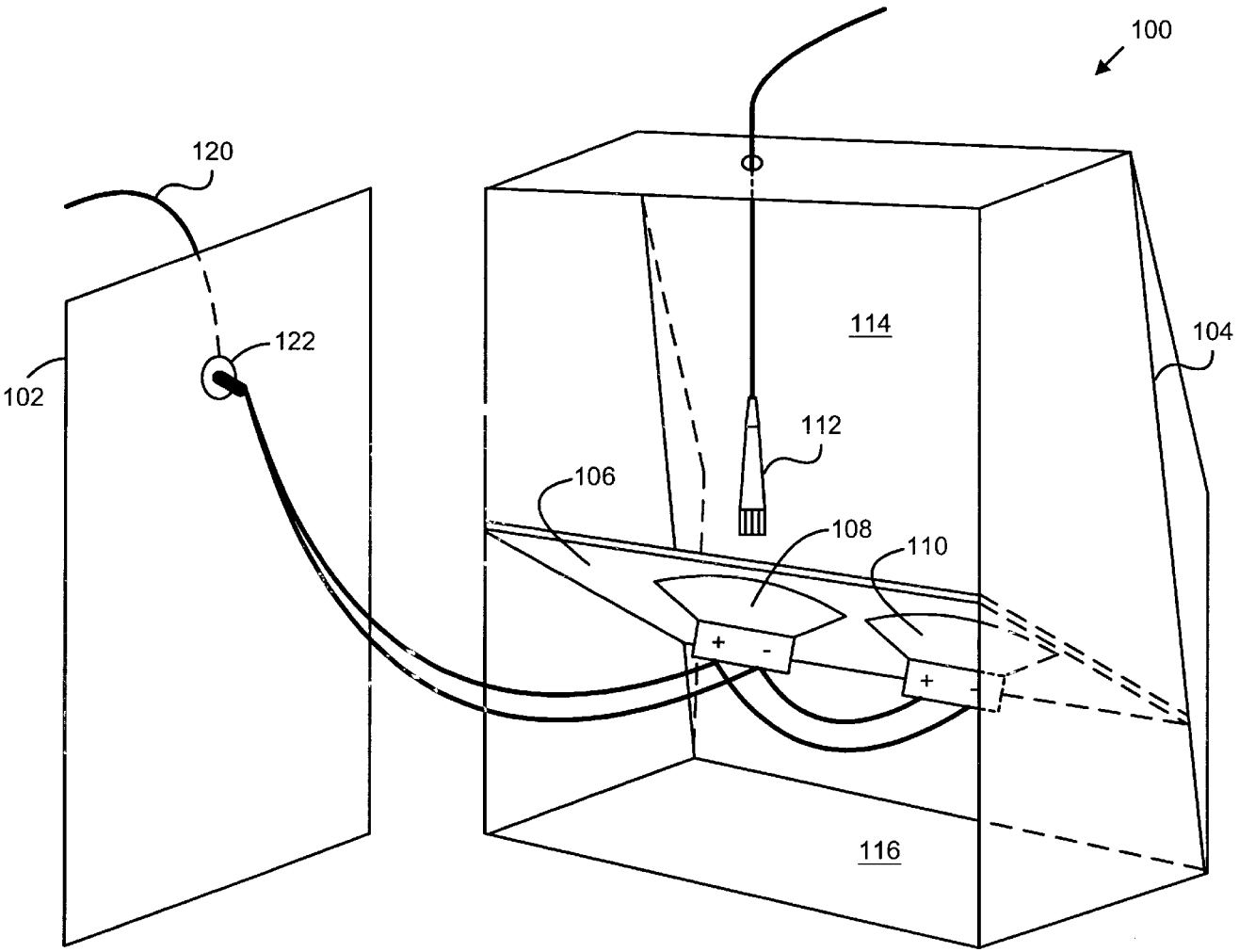
FIG. 1 shows a cutaway view of an embodiment of the present invention.

FIG. 1 shows a cutaway view of a preferred embodiment of the invention. Isolation cabinet 100 is shown with back 102 open for purposes of illustration. This version of the cabinet was constructed using a commercially-available speaker cabinet manufactured by Jim Marshall Products, Ltd. It is a so-called "4 by 10" speaker cabinet which denotes that it originally housed four speakers whose diameters are approximately 10 inches, each. The particular shape of the cabinet, i.e., wider at the bottom and narrower at the top, is only due to the design of the original cabinet which was used to prototype the invention for practical reasons. Since the original cabinet was open-faced to allow the sound of the 4 speakers to emanate, a panel 104 was used to cover the openings.

The cabinet measures approximately 24" high and 24" wide. It is 11" deep at its base and 9.5" deep at it's top. Mounting support panel 106 is used to support speakers 108 and 110. The speakers are identical 8 ohm, 10" speakers manufactured by Celestion International, Ltd., with part numbers G10L-35. The higher edge of the mounting panel is about 11" from the base of the cabinet while the lower edge of the mounting panel is about 3.5" from the base. Thus, the speakers are inclined toward the front of the cabinet. The angle of inclination is not critical. Also, no inclination needs to be used although the position illustrated produces good tones and prevents matter from collecting in the speaker cones. The mounting panel spans the cross-section of the cabinet to create primary chamber 114 and secondary chamber 116. The preferred embodiment uses acoustic foam, approximately 1.5" to 2" thick, on all of the inner surfaces of the cabinet including back panel 102, but not on mounting support panel 106.

Microphone 112 is a Beta 57 microphone manufactured by Shure and is suspended by microphone cable so that its tip is about 2.5" from the center of speaker 108. Input cable 120 couples to jack 122 to provide a two-conductor input to the speakers. Note that the signal is applied in a first polarity to speaker 108, but is applied in reversed polarity to speaker 110.

In operation, back panel 102 is secured to the isolation cabinet with screws to create two chambers 114 and 116 that are sufficiently acoustically sealed off from each other. An amplified electric guitar signal is applied via input 120 to jack 122 so that speakers 108 and 110 are driven. In the preferred embodiment, a 50-watt guitar amplifier model JCM-800 made by Jim Marshall Products, Ltd., is used. The signal is applied to speaker 108 in normal polarity, and is applied to speaker 110 in reversed polarity. Thus, whenever the cone of speaker 108 pushes out in response to the sound signal, speaker 110's cone will pull in. This creates a complimentary pressure effect in primary chamber 114. Also, a complimentary signal is created in secondary chamber 116 in a similar manner. Naturally, speaker 108 pulls in while speaker 110 pushes out so the effect is symmetrical.

The complimentary use of the two speakers, along with the dual chamber arrangement to alleviate the back pressure, reduces the dampening effect of moving air in a small enclosed volume. As a result, the guitar tones are produced in a fashion very close to the "live" sound, as where a speaker, or speakers, is used in the open air. Microphone 112 picks up the sound signal, primarily from speaker 108, and transmits the sound as an electrical signal through the microphone cable to external equipment (not shown). The external equipment can be, for example, a recording device, headphones, sound effects processors, etc. Thus, the present invention provides a way to obtain a live sounding isolated guitar tone for use in recording or for other purposes.

Note that many design tradeoffs are possible that deviate from the specific embodiment shown in FIG. 1. Naturally, many different dimensions and shapes for the cabinet are possible. These can be rectangular or curved. Many materials are suitable for constructing the cabinet. Many shapes for the chambers 114 and 116 are possible. Primary chamber 114 need not be larger than secondary chamber 116. The position of microphone 112 may be anywhere in the cabinet, even in secondary chamber 116. In fact, by placing microphone 112 in different positions within the cabinet, different types of tones are emphasized. In the position shown in FIG. 1, the resulting sound signals as transmitted by microphone 112 were found to be "bassy," or strong in low frequencies. To compensate for this, the electrical signal is passed through an equalization unit to roll off the low end. Such modifications to the basic sound are well known and are part of the artistry in recording guitar tones that vary from musician to musician and among recording engineers and producers.

The distance of the microphone to the speaker is easily regulated by raising or lowering the microphone by its cable. In the preferred embodiment, the distances from the microphone to speaker 108 are marked on the cable itself. The cable is prevented from slipping by using a clamp or other means to secure the cable to the cabinet top (not shown). Many other ways to set the distance and position of the microphone relative to the speaker are possible. By putting the microphone uniformly between the speakers there may be advantages in tone or volume registering. Naturally, different types of microphones can be used to yield different tones, as is known in the art. A small microphone element can even be attached to the speaker cone itself, or affixed to the wall (inner or outer) of the cabinet.

It is not necessary to line the inside of the cabinet with acoustic foam. In fact, a truer live guitar tone was produced when the foam was not used. However, using the foam cuts down greatly on the amount of noise leaking out of the cabinet.

Figure 2:
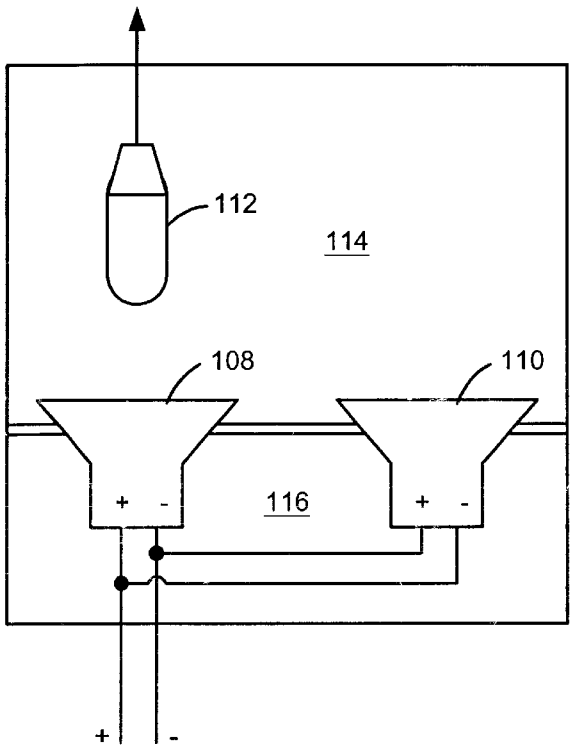
FIG. 2 is a schematic drawing of the configuration shown in FIG. 1.

FIG. 2 shows schematically the arrangement of microphone, speakers and chambers of the embodiment of FIG. 1. Note that microphone. 112, chamber 114, speakers 108, 110 and chamber 116 correspond to their identically numbered counterparts in FIG. 1.

Figure 3:
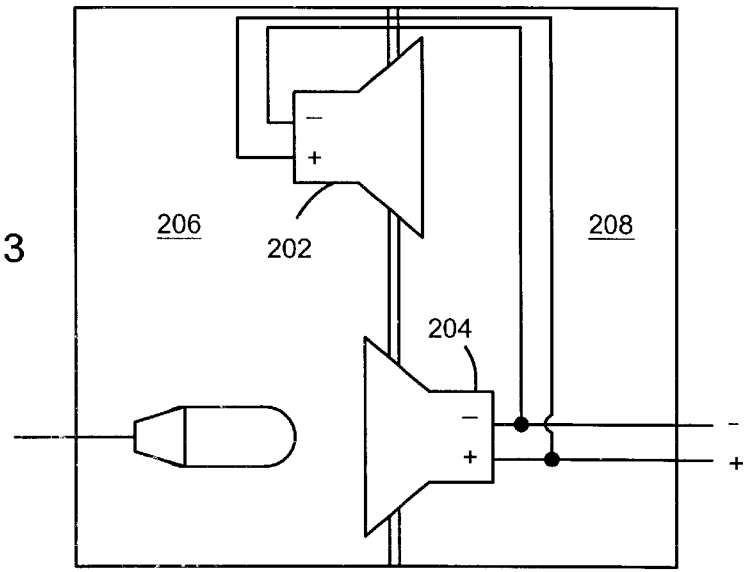
FIG. 3 is a schematic drawing of a second configuration.

FIG. 3 shows an arrangement where the speakers are connected in parallel, but in the same polarity. Speaker 202 is mounted in the opposite direction from speaker 204. Although feasible, this arrangement probably will not produce tones as well as the arrangement of FIG. 2 because the vibrating surfaces are not matched within each of the chambers 206 and 208. However, different microphone placements might yield improved results. Note that the microphone can be placed in either of the chambers with identical results due to their symmetry. In this respect, the arrangement of FIG. 3 can be more suitable for a stereo recording where an additional microphone is used in front of speaker 202 (not shown).

Figure 4:
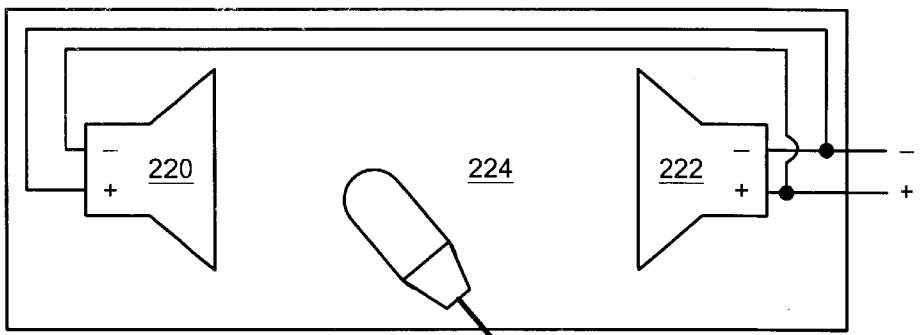
FIG. 4 is a schematic drawing of a third configuration.

FIG. 4 shows yet another arrangement where the speakers 220 and 222 are wired in opposite polarity but co-exist within a single chamber 224. Although the microphone is placed closer to one of the speakers, interesting or more desirable results may be achieved with the microphone in the center of the arrangement. The arrangement of FIG. 4 is suitable for a small device. Indeed, with sufficiently small speakers and a microphone, the isolation cabinet can be made to fit into the palm of a hand, or smaller. Many other arrangements are possible.

Although the present invention has been illustrated with respect to specific embodiments as described herein, many modifications are possible. For example, more than two speakers can be used as long as they are arranged so that the air compression from one speaker is compensated by a reaction from one or more of the other speakers. In such a case, the several speakers reacting to a main speaker might be smaller in size than the main speaker. By different arrangement of chambers and shape of cabinet it may be possible to have three or more speakers of the same or different size adequately compensate so that sampling the sound from one or more of the speakers by optimum microphone placement can yield superior results. More than 1 microphone can be used and the resulting signals can be combined at later stages for improved sound, such as stereo sound, or for special effects. A miniature version of the device can be built by using smaller speakers, microphone and cabinet enclosure. Also, electromagnetic coil speakers, like type described in the examples above, need not be used. Any audio transducer, or means of moving air or another medium to produce sounds can be used with the present invention. For example, piezoceramic benders, which are small flat plates without electromagnetic coils, can be used to produce sound. The medium need not be air but can be another gas.

Naturally, sound sources other than an electric guitar can be used. For example, the sound source can be a human voice; brass, woodwind, string or other instrument.

The scope of the invention is to be limited only by the appended claims.

What is claimed is:

1. An isolation cabinet for producing and recording sound in isolation of an external environment, the isolation cabinet comprising:

a speaker cabinet acoustically sealed from the external environment so that emanation of sound from the speaker cabinet is prevented;

an input for receiving an external electrical signal;

first and second speakers enclosed within the speaker cabinet, wherein each speaker includes a surface that is electromagnetically responsive to the electrical signal to produce sound by moving air within the cabinet, wherein the speaker cabinet does not provide a substantial unsealed path between a speaker surface and the exterior of the speaker cabinet;

a microphone positioned inside the speaker cabinet for converting the motion of air inside the speaker cabinet into an output signal; and a coupling between the input and the first and second speakers so that the air in at least one region of the speaker cabinet is moved in a first direction in response to the first speaker and is moved in a second direction, different from the first direction, in response to the second speaker to produce sound within the speaker cabinet in response to the electrical signal.

2. The isolation cabinet of claim 1, further comprising:

an output for transmitting signals from the microphone to a device external to the cabinet.

3. The isolation cabinet of claim 1, wherein the speaker cabinet is substantially rectangular, the isolation cabinet further comprising:

a mounting support for fixedly securing the two speakers within the speaker cabinet, wherein the speakers are mounted side-by-side in the same facing direction; and the coupling including means to apply the electrical signal in a first polarity to the first speaker, and in a second, opposite, polarity to the second speaker, so that when the first speaker moves in a first direction in response to the electrical signal, the second speaker moves in a second, opposite direction, in response to the same electrical signal.

4. The isolation cabinet of claim 3, further comprising:

the mounting support serving to divide the cabinet enclosure into first and second chambers, wherein the fronts of the speakers from one side of the chamber and wherein the backs of the speakers from one side of the second chamber.

5. The isolation cabinet of claim 4, further comprising a microphone, wherein the microphone is located in the first chamber, wherein the microphone is positioned above one of the speakers.

6. The isolation cabinet of claim 5, further comprising:

sound insulation material lining part of the walls of the interior of the cabinet enclosure.

7. The isolation cabinet of claim 5, further comprising:

support means for the microphone for fixing the microphone position relative to the speakers.

8. The isolation cabinet of claim 7, wherein the support means is a cable attached to the microphone and passed through an opening at the top of the cabinet.

9. The isolation cabinet of claim 8, wherein the cable is adjustable to change the distance of the microphone from the speakers.

10. An isolation cabinet for producing sound in isolation of an external environment, the isolation cabinet comprising:

a speaker cabinet, wherein the speaker cabinet is acoustically sealed from the external environment;

first and second speaker surfaces for actively producing first and second sound waves in a first region within the speaker cabinet, wherein the first and second speaker surfaces are responsive to a common sound signal source to actively produce a simultaneous compression and rarefaction in the first region, wherein the speaker cabinet does not provide an open path between a speaker surface and the exterior of the cabinet enclosure; and means for detecting the sound waves within the enclosure.

11. The isolation cabinet of claim 10, wherein the means for producing first and second sound waves includes a speaker.

12. The isolation cabinet of claim 10, wherein the means for producing first and second sound waves includes a piezoceramic bender.

13. The isolation cabinet of claim 10, wherein the means for producing first and second sound waves includes a vibrating surface.

14. The isolation cabinet of claim 10, wherein the means for detecting the sound waves includes a microphone.

15. The isolation cabinet of claim 10, wherein the means for producing first and second sound waves includes two speakers fixed in a side-by-side orientation within the enclosure.

16. The isolation cabinet of claim 10, wherein the means for producing first and second sound waves includes two speakers in a face-to-face orientation within the enclosure.

17. The isolation cabinet of claim 10, wherein the means for producing first and second sound waves includes two speakers in an in-line orientation within the enclosure.

18. The isolation cabinet of claim 10, wherein the means for producing first and second sound waves includes two sound sources, wherein the means for detecting the sound waves includes a microphone near one of the sound sources.

19. The isolation cabinet of claim 10, wherein the means for producing first and second sound waves includes two sound sources, wherein the means for detecting the sound waves includes a microphone between the sound sources.

20. An isolation cabinet for producing sound in isolation of an external environment, the isolation cabinet comprising:

a speaker cabinet, wherein the speaker cabinet is acoustically sealed from the external environment;

a panel dividing the speaker cabinet into two chambers;

first and second speakers responsive to an electrical signal to actively produce sound, wherein the speakers are enclosed within the cabinet enclosure and mounted to the panel in a side-by-side arrangement so that the fronts of the speakers face into a first of the chambers while the rears of the speakers protrude into the second of the chambers, wherein the speaker cabinet does not provide an open path between a speaker surface and the exterior of the cabinet enclosure; and a microphone fixed within the first chamber above one of the speakers with an output providing the signal generated by the microphone to an external device.

21. The isolation cabinet of claim 1, wherein the first and second directions are substantially opposite to each other.

22. The isolation cabinet of claim 1, wherein the microphone is located within the first region.

23. The isolation cabinet of claim 1, wherein the first and second directions are substantially parallel to each other.

* * * * *